United States Patent [19]

Honma

[11] Patent Number: 4,801,146

[45] Date of Patent: Jan. 31, 1989

[54] GOLF CLUB HEAD

[75] Inventor: Yukihiro Honma, Kawasaki, Japan

[73] Assignee: Kabushiki Kaisha Honma Gorufu Kurabu Seisakusho, Yokohama, Japan

[21] Appl. No.: 943,118

[22] Filed: Dec. 17, 1986

[30] Foreign Application Priority Data

Dec. 26, 1985 [JP] Japan ..... 60-199158[U]
Jan. 29, 1986 [JP] Japan ..... 61-15909

[51] Int. Cl.[4] ..... A63B 53/04

[52] U.S. Cl. ..... 273/173; 273/77 A; 264/510

[58] Field of Search ..... 273/173, 174, 167, 175, 273/77 A, 168, 78, 169, 170, 171

[56] References Cited

U.S. PATENT DOCUMENTS 3,695,618 10/1972 Woolley et al. ..... 273/173
4,630,826 12/1986 Nishigaki et al. ..... 273/173

*Primary Examiner*—George J. Marlo
*Attorney, Agent, or Firm*—Jordan and Hamburg

[57] ABSTRACT

This invention relates to a wood club head used for golf, and more particularly to a head in which a face insert made of brass or the like which is soft and has a high specific gravity is embedded into a main face body made of resin-impregnated carbon fibers or the like, and a face with a part of the insert exposed to the surface of the main face body is incorporated therein.

11 Claims, 6 Drawing Sheets

FIG.6

WEIGHT DISTRIBUTION OF CONVENTIONAL WOOD CLUB HEAD (UNIT : GRAM)

| MEMBER \ CLUB COUNT | #1 | #2 | #3 | #4 | #5 | #6 | #7 | #8 | #9 |
|---|---|---|---|---|---|---|---|---|---|
| WOOD PORTION | 128 | 122 | 116 | 110 | 104 | 98 | 92 | 86 | 80 |
| SOLE PLATE & SCREW | 18 | 23 | 28 | 33 | 38 | 43 | 48 | 53 | 58 |
| SIDE SOLE & SCREW | 19 | 21 | 24 | 27 | 29 | 32 | 34 | 37 | 39 |
| FACE & SCREW | 17 | 17 | 16 | 16 | 15 | 15 | 14 | 14 | 13 |
| LEAD MATERIAL | 31 | 35 | 39 | 43 | 47 | 50 | 55 | 58 | 63 |
| TOTAL WEIGHT | 213 | 218 | 223 | 228 | 233 | 238 | 243 | 248 | 253 |

WEIGHT DISTRIBUTION OF WOOD CLUB HEAD WITH FACE INCORPORATED ACCORDING TO THE PRESENT INVENTION (UNIT : GRAM)

| MEMBER \ CLUB COUNT | #1 | #2 | #3 | #4 | #5 | #6 | #7 | #8 | #9 |
|---|---|---|---|---|---|---|---|---|---|
| WOOD PORTION | 128 | 122 | 116 | 110 | 104 | 98 | 92 | 86 | 80 |
| SOLE PLATE & SCREW | 18 | 23 | 28 | 33 | 38 | 43 | 48 | 53 | 58 |
| SIDE SOLE & SCREW | 19 | 21 | 24 | 27 | 29 | 32 | 34 | 37 | 39 |
| FACE & SCREW | 17 | 21 | 25 | 29 | 33 | 37 | 41 | 45 | 49 |
| LEAD MATERIAL | 31 | 31 | 30 | 29 | 29 | 28 | 28 | 27 | 27 |
| TOTAL WEIGHT | 213 | 218 | 223 | 228 | 233 | 238 | 243 | 248 | 253 |

GOLF CLUB HEAD

BACKGROUND OF THE INVENTION

The present invention relates to a wood club head used for gold and method of manufacturing the same.

A wood club of the kind as described has been known in which, to enhance the bounding properties of a ball when struck, a face which is formed integrally of carbon fibers impregnated with a thermosetting resin or the like or formed principally of a thermosetting resin and applied with another resin as an ornament is integrally incorporated into and secured to the front surface of the head against which a ball is struck. The total weight of the head varies with the count of the club (the greater the count, the greater the total weight of the head) but is decided according to the weight distribution of head-constituting members such as the wood portions of the head, lead material embedded into the wood portions, a sole plate incorporated into the lower surface of the wood portion, the face, screws for fastening the face and sole plate, etc. More specifically, in clubs having large counts, the total weight of the head is increased by reducing the volume of the wood portion and the like having a small specific gravity and increasing the volume of the lead, the sole plate and the like having a greater specific gravity.

However, the aforementioned conventional wood club head involves the following problems:

(1) Since the face applying an impact to a ball is formed of hard material, the ball is liable to be damaged.

(2) For the same reason as described above, the impact when hitting a ball transmitted to the club hand grip is great, failing to give a better striking feel.

(3) A suitable loft (inclination) is set in the hitting surface including the face and the hitting surface is formed into an outwardly slightly inflated convex surface, and therefore, it is difficult to visually discern the direction of the hitting surface with respect to the hitting direction.

Moreover, as previously mentioned, in a club having a large count, the capacity of the lead embedded into the head is large and therefore, there sometimes occur "cracks" or the like in the wood portion of the head due to the impact during striking, temperature, humidity and the like.

SUMMARY OF THE INVENTION

It is an object of the present invention to overcome the above-noted problems.

For achieving the above-described object, the present invention provides a wood club in which a required number of face inserts made of a metal material such as brass which is softer than a main face body and has a high specific gravity are embedded into a main face body principally formed of a hard material such as carbon fibers impregnated with resin, and a face having a part of the face insert exposed at the surface of the main face body is incorporated therein.

That is, in the manufacture of a club head, face insert molding materials preliminarily worked into a rod or sheet-like configuration are combined with a main face body molding material in a laminated fashion, these materials are heated and pressurized within a mold to provide an integral form, the form is removed from the mold and cut into the required size to obtain a plurality of faces, and the faces are incorporated into a head body.

Since the face insert is soft as compared with the main face body portion, it is not only possible to prevent damage to the ball when struck but also possible to lighten the impact applied to the head to obtain a better handgrip feel. A face insert with an end exposed to the upper surface of the club head as a thithin a mold to provide an integral form, the form is removed from the mold and cut into the required size to obtain a plurality of faces, and the faces are incorporated into a head body.

Since the face insert is soft as compared with the main face body portion, it is not only possible to prevent damage to the ball when struck but also possible to lighten the impact applied to the head to obtain a better handgrip feel. A face insert with an end exposed to the upper surface of the club head as a thin strip substantially parallel to the hitting surface is embedded whereby the exposed portion can be seen linearly from the top of the head, and therefore, it becomes possible to visually discern the angular relationship and positional relationship of the hitting surface with respect to the hitting direction. In addition, the number and size of these face inserts are adjusted to increase the weight thereof whereby the weight distribution of the lead material embedded into the wood portion of the head may be reduced to prevent occurrence of a "crack" in the wood portion.

The method of manufacturing a head comprises combining, in a laminated fashion, face body molding materials formed of carbon fibers impregnated with a thermosetting resin or the like and main and side face insert molding materials formed of brass or the like to provide an integral structure, and cutting the integral structure to obtain multiple pieces. This makes it possible to produce a number of faces precisely and effectively.

While the outline of the present invention has been set forth briefly, other objects and new features of the present invention will be more clearly understood by reading the ensuing detailed description in connection with the embodiments shown in the accompanying drawings. It is to be noted, however, that the drawings merely illustrate one embodiment for explanation of the present invention and do not limit the technical scope of the present invention.

BRIEF DESCRIPTION OF THE DRAWINGS

FIG. 6 is a comparative table showing the weight distribution of the wood club head.

DESCRIPTION OF THE PREFERRED EMBODIMENT

An embodiment of the present invention will be described hereinafter with reference to the drawings.

Figure 1:
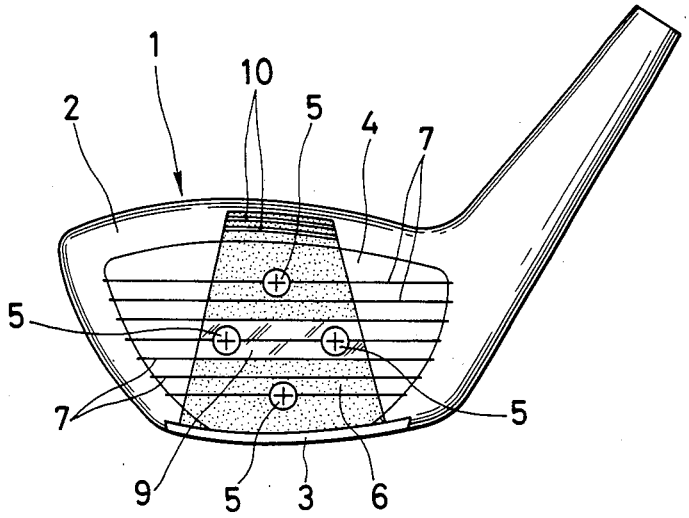
FIG. 1 is a front view of a wood club head in accordance with one embodiment of the present invention.
Figure 2:
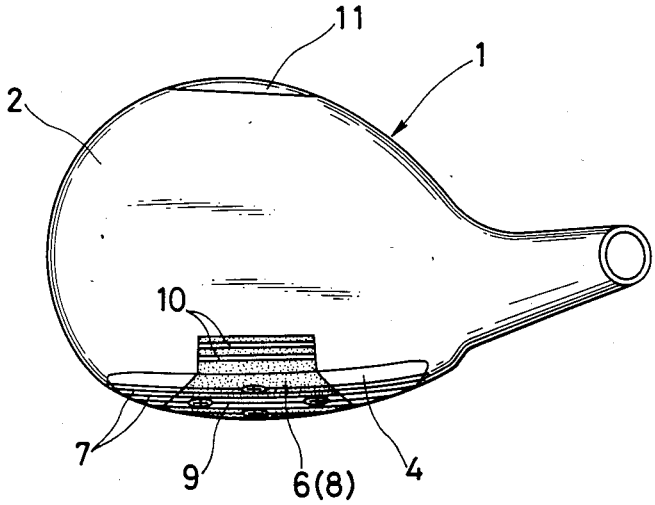
FIG. 2 is a plan view of the wood club head.
Figure 3:
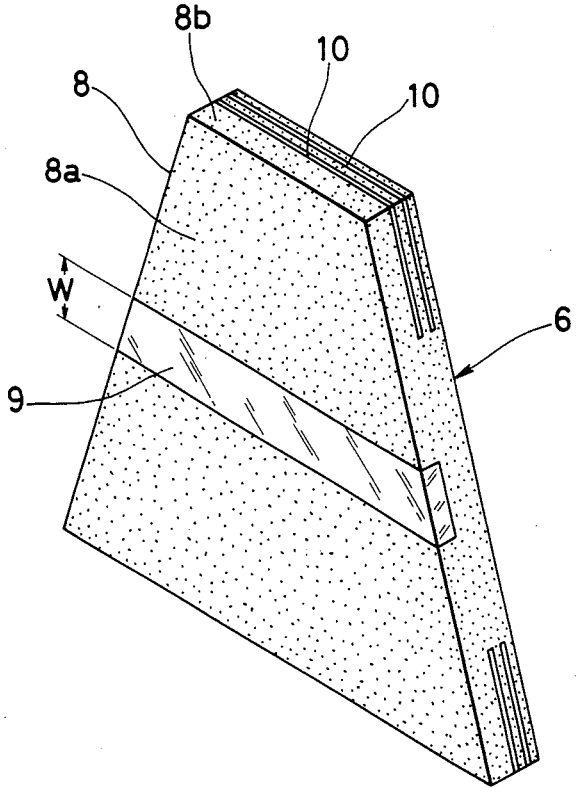
FIG. 3 is a perspective view of a club face.

Referring to FIGS. 1 and 2, a wood club head generally designated at 1 is basically composed of a wood portion 2 made of persimmon or the like and having a lead material (not shown) embedded therein as a mass body, a sole plate 3 integrally incorporated into and secured to the lower surface of the wood portion 2 by means of screws (not shown) and made of a metal material such as stainless steel, and a front face 6 integrally incorporated into and secured to a hitting surface 4 frontwardly of the wood portion 2 by means of screws 5. The hitting surface 4 is constructed such that the face 6 is incorporated into and secured in a recessed portion formed in the front of the wood portion 2 and thereafter integrally subjected to polishing to finish it into a convex surface, the hitting surface 4 being formed with a number of horizontal grooves 7. As shown in FIG. 3 in an enlarged scale, the face 6 includes a main face body 8 principally formed of hard carbon fibers impregnated with a thermosetting resin and a transverse main face insert 9 horizontally embedded in a part of the front surface 8a of main body 8. One surface of insert 9 is exposed as a long and narrow front strip. Insert 9 is made of brass (copper, zinc alloy) which is softer than the impregnated carbon and has a high specific gravity. Face 6 also includes two sheet-like side face inserts 10, 10 embedded parallel (substantially parallel to the hitting surface 4) to the front surface 8a of the main face body 8 in the upper portion of the latter, an end of each insert being exposed as a thin strip along the upper surface 8b of the main face body (upper surface of the head 1), inserts 10 being made of the same material (brass) as that of main face insert 9. Reference numeral 11 designates a back sole secured to the side of the wood portion 2 opposite face 6 in order to balance the weight, back sole 11 being made of brass or the like.

Figure 4:
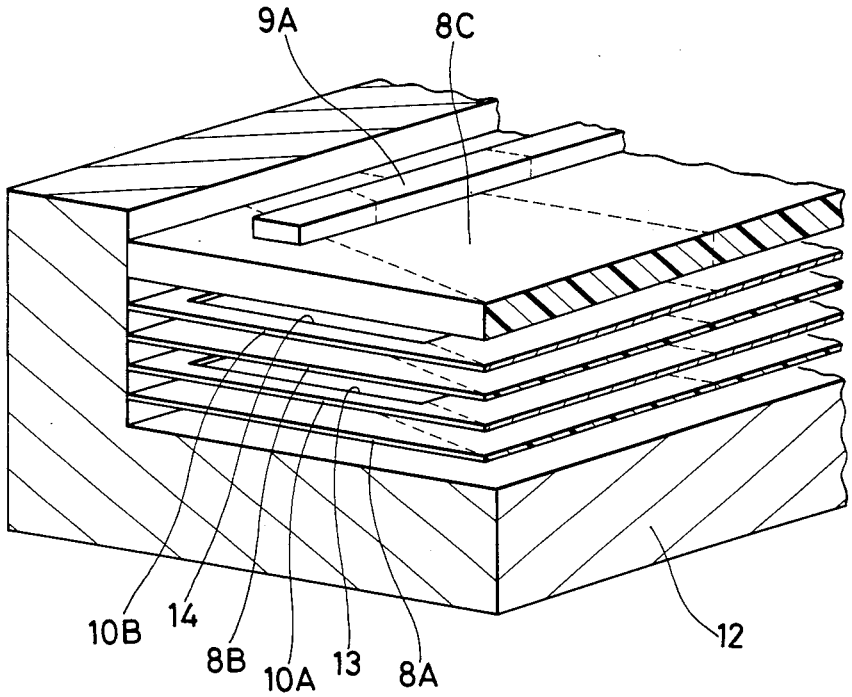
FIG. 4 is an explanatory view showing a part of the manufacturing method.
Figure 5:
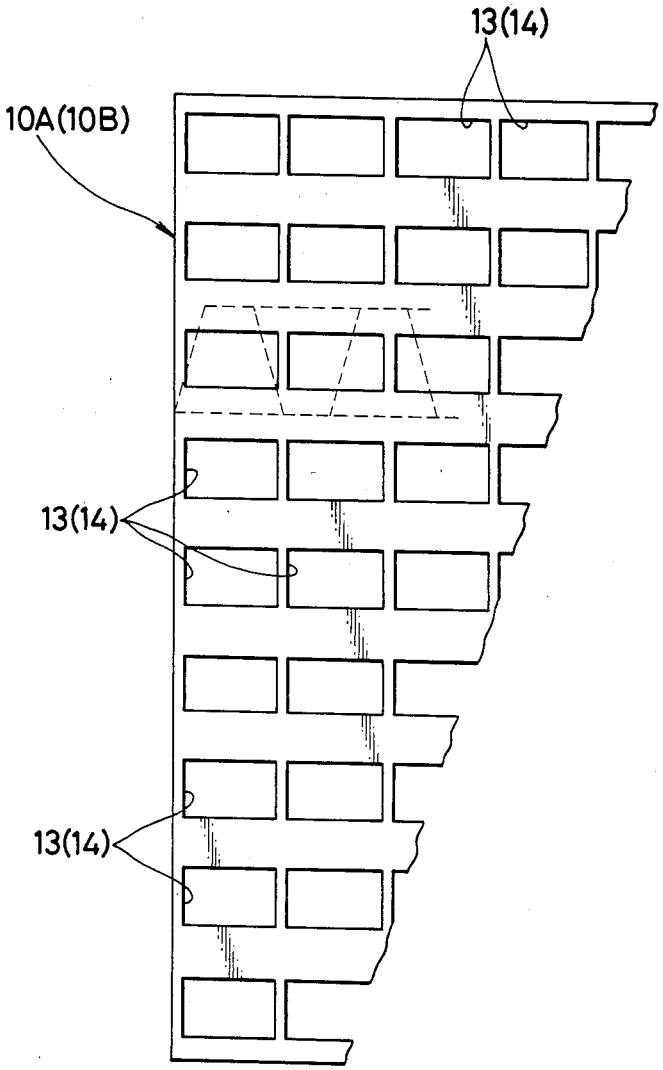
FIG. 5 is a plan view of a part of a side face insert molding material.

In the manufacture of the face 6, carbon fibers are impregnated or coated with an epoxy resin into which a predetermined hardener is mixed, the impregnated fibers are then heated (at 90° C. for 20 minutes), a number of half-dried prepregs are molded, these prepregs are placed one over another top prepare face body molding materials 8A, 8B, 8C in three-layers having a suitable thickness, and a main face insert molding material 8A and side face insert molding materials 10A, 10B having predetermined shape and thickness are prepared. Next, as shown in FIG. 4, these molding materials 8A, 8B, 8C, 10A and 10B are put into a mold 12 in a laminated fashion, heated (at 120° C. for 60 minutes), and pressurized (at 17 kg/cm$^2$) to provide an integral structure, after which the latter is removed from the mold 12 and cut into the desired size. The molding materials 8A, 8B, 8C, 10A and 10B are, before cutting, of a size whereby the components of the faces 6 may be obtained in multiple pieces, and for example, the side face insert molding materials 10A, 10b are molded in the size of approximately 48 cm in longitudinal dimension and 47.5 cm in lateral dimension. FIG. 5 shows a plan view of a part of the side face insert molding material 10A, and the size per face 6 product is shown by the broken lines. The rod-like main face insert molding material 9A is arranged laterally in the figure, and these materials are prepared by the number in rows thereof arrayed in the vertical direction. The side face insert molding materials 10A, 10B are preformed with a number of holes 13, 14 for adjusting the weight of the materials 10A, 10B. These holes 13, 14 vary with the count of the wood club with the face 6 incorporated therein, and the holes are sometimes not formed for use in heavy clubs. The face 6 obtained by the above-described steps is incorporated into the recess portion frontwardly of the wood portion 2 of the wood club head and finished into a convex surface by polishing, as previously mentioned.

In the face 6, the main face insert 9 wherein the hitting surface 4 (the face 6 surface) is soft functions to minimize the damage given to the ball when struck and relieve the impact applied to the head 1, whereas the side face insert 10 functions to make it easy to visually determine the direction of the hitting surface 4 with respect to the hitting direction because the end of the insert 10 exposed at the upper surface of the head 1 brightly glitters with a luster peculiar to brass, and a player may employ the ends of inserts 10 as two straight lines substantially parallel to the hitting surface 4.

Figure 7:
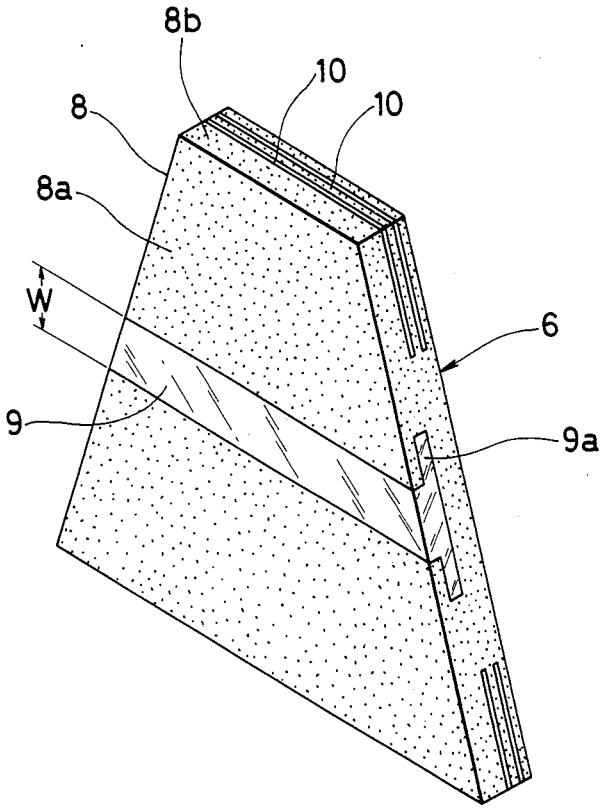
FIG. 7 is a perspective view showing another example of a club face.

The direction, number and size of the main face insert 9 and the number, thickness and the like of the top side face insert 10 are suitably predetermined. The weight of the face 6 is increased or decreased depending on the number and size of both the face inserts 9, 10 and the total weight of the head 1 may be adjusted. Because of this, FIG. 6 represents one example of the weight distribution of the various elements while comparing it with prior art constructions, and as shown therein, the quantity of lead material embedded into the wood portion 2 may be relatively reduced. In this case, the top side face insert 10 may be adjusted in weight by boring a number of holes 13, 14 having a suitable size as previously mentioned but the main face insert 9, as shown in FIG. 7, can increase and decrease in weight by the size of a portion 9*a* embedded into the face body 8 to always maintain constant the width (W) of the surface appearing in the form of an exposed strip on the front surface 8*a* of the body 8. Thereby, both the face inserts 9, 10 can be designed to accommodate the appearance of a club set to enhance the effect in terms of design.

According to the wood club head with the face incorporated therein constructed as described above, by the face inserts embedded in the face, the damage to the ball can be minimized and the hitting feeling can be enhanced. In addition, the direction of the face (hitting surface) is easily determined. Furthermore, the quantity of the lead material embedded into the wood portion can be reduced by the weight of the face insert to prevent a "crack" in the wood portion resulting from the impact, and the change in temperature and humidity during hitting.

The manufacturing method according to the present invention is extremely standardized and simplified to make it possible to easily produce a high-quality head with a face incorporated therein which may achieve the intended object.

While a preferred embodiment of the present invention has been described, it will be obvious that in the present invention, many other modifications may be made without departing from the principle thereof. It is therefore intended that all modifications by which the effects of the present invention may be substantially obtained through the use of structure substantially identical with or corresponding thereto are included in the scope of the present invention.

What is claimed is:

1. A golf club head comprising a wood club head having a top surface, a front surface and a recess formed in said front surface, a front face body having a predetermined hardness and specific gravity secured in said recess for contact with a golf ball, said front face body having a front face and a horizontal recess formed in said front face, and a front face insert secured in the horizontal recess of said front face body, said front face insert being made of a metal having a greater specific gravity and lower hardness than the specific gravity and hardness of said front face body, whereby said front face insert prevents damage to a golf ball and minimizes the impact applied to the wood club head when the front face insert strikes a golf ball.

2. A golf club head according to claim 1, wherein said front face body is made of carbon fibers impregnated with a thermosetting resin and said front face insert is made of brass.

3. A golf club head according to claim 1 further comprising a front face insert extension formed integrally with said front face insert and embedded in said front face body at a rear portion of said front surface recess.

4. A golf club head according to claim 1 further comprising at least one insert plate embedded in said front face body, said insert plate being aligned substantially parallel to the front face of said front face body and having an end terminating at the top surface of said wood club head, whereby a golfer may determine the hitting direction visually from the terminating end of the insert plate aligned substantially parallel to the front face of said front face body.

5. A golf club head according to claim 4, wherein said insert plate is made of a metal having a greater specific gravity and lower hardness than the specific gravity and hardness of said front face body.

6. A golf club head according to claim 5, wherein said metal insert plate is brass.

7. A golf club head according to claim 4, wherein said insert plate include at least one hole bored therein.

8. A golf club head according to claim 1 further comprising a pair of parallel insert plates embedded in said front face body, each said insert plate being aligned substantially parallel to the front face of said front face body and having an end terminating at the top surface of said wood club head, whereby a golfer may determine the hitting direction visually from the terminating ends of the insert plates aligned substantially parallel to the front face of the front face body.

9. A golf club head according to claim 8, wherein said insert plates are made of a metal having a greater specific gravity and lower hardness than the specific gravity and hardness of said front face body.

10. A golf club head according to claim 9, wherein said metal insert plates are brass.

11. A golf club head according to claim 8, wherein each insert plate includes at least one hole bored therein.

* * * * *